US008925920B2

(12) United States Patent
Umi et al.

(10) Patent No.: US 8,925,920 B2
(45) Date of Patent: Jan. 6, 2015

(54) PAPER CONVEYING APPARATUS, ABNORMALITY DETECTION METHOD, AND COMPUTER-READABLE, NON-TRANSITORY MEDIUM

(71) Applicant: PFU Limited, Kahoku (JP)

(72) Inventors: Takayuki Umi, Kahoku (JP); Masanobu Hongo, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/966,808

(22) Filed: Aug. 14, 2013

(65) Prior Publication Data

US 2014/0077448 A1 Mar. 20, 2014

(30) Foreign Application Priority Data

Sep. 14, 2012 (JP) ..... 2012-203504

(51) Int. Cl.
*B65H 7/02* (2006.01)
*B65H 5/00* (2006.01)
*G03G 15/00* (2006.01)

(52) U.S. Cl.
CPC ..... *B65H 5/00* (2013.01); *G03G 15/70* (2013.01); *G03G 2215/00637* (2013.01)
USPC ..... 271/258.01; 271/265.01; 271/258.02; 271/258.04

(58) Field of Classification Search
USPC ..... 271/256, 258.01, 258.03, 258.04, 259, 271/264, 265.01, 265.02
See application file for complete search history.

(56) References Cited

U.S. PATENT DOCUMENTS

| | | | | |
|---|---|---|---|---|
| 3,603,680 | A * | 9/1971 | Barton | 399/21 |
| 7,502,570 | B2 * | 3/2009 | Nishimura | 399/8 |
| 7,587,299 | B2 * | 9/2009 | Miyasaka et al. | 702/183 |
| 8,567,777 | B2 * | 10/2013 | Syracuse et al. | 271/263 |
| 8,585,050 | B2 * | 11/2013 | Syracuse et al. | 271/258.01 |
| 2005/0189707 | A1 | 9/2005 | Sano et al. | |

(Continued)

FOREIGN PATENT DOCUMENTS

| | | |
|---|---|---|
| JP | 57-169767 | 10/1982 |
| JP | 03-175460 | 7/1991 |

(Continued)

OTHER PUBLICATIONS

Office action mailed Jul. 16, 2013 in JP 2012-195225, including English translation, 7pp.

(Continued)

*Primary Examiner* — Ernesto Suarez
(74) *Attorney, Agent, or Firm* — Christie, Parker & Hale, LLP

(57) ABSTRACT

There are provided a paper conveying apparatus, a jam detection method and a computer-readable, non-transitory medium that suppress erroneous detection of occurrence of a jam by a sound due to a sound generated from the apparatus. The paper conveying apparatus includes a sound signal generator, provided with a sound detector near a conveyance path of paper, for generating a sound signal, a sound jam detector for determining whether a jam has occurred based on the sound signal output during a paper conveying operation, a control module for performing abnormal processing when the sound jam detector determines that the jam has occurred, and an abnormal sound detector for determining whether an abnormal sound has been generated based on the sound signal output before a paper conveying operation.

7 Claims, 14 Drawing Sheets

(56) References Cited

U.S. PATENT DOCUMENTS

| | | | | |
|---|---|---|---|---|
| 2007/0018376 | A1 | 1/2007 | Sano et al. | |
| 2007/0177887 | A1 | 8/2007 | Haas et al. | |
| 2009/0003857 | A1 | 1/2009 | Kuramochi et al. | |
| 2009/0041485 | A1 | 2/2009 | Shoji et al. | |
| 2012/0019841 | A1 | 1/2012 | Schaertel et al. | |
| 2012/0235921 | A1 | 9/2012 | Laubach | |
| 2012/0235929 | A1 | 9/2012 | Hongo et al. | |
| 2013/0093136 | A1 | 4/2013 | Sakharshete et al. | |
| 2013/0140757 | A1* | 6/2013 | Phinney et al. | 271/10.01 |
| 2013/0300056 | A1* | 11/2013 | Kai | 271/262 |
| 2014/0054252 | A1 | 2/2014 | Woodley et al. | |
| 2014/0054840 | A1 | 2/2014 | Umi et al. | |
| 2014/0054841 | A1* | 2/2014 | Morikawa et al. | 271/10.01 |
| 2014/0054849 | A1* | 2/2014 | Morikawa et al. | 271/264 |
| 2014/0054850 | A1* | 2/2014 | Umi et al. | 271/264 |
| 2014/0054851 | A1* | 2/2014 | Morikawa et al. | 271/264 |
| 2014/0054852 | A1* | 2/2014 | Hongo et al. | 271/264 |
| 2014/0062008 | A1 | 3/2014 | Hongo et al. | |

FOREIGN PATENT DOCUMENTS

| | | |
|---|---|---|
| JP | 5-97283 | 4/1993 |
| JP | 5-97284 | 4/1993 |
| JP | 11-116098 | 4/1999 |
| JP | 2001-302021 | 10/2001 |
| JP | 2005-082350 | 3/2005 |
| JP | 2005-249819 | 9/2005 |
| JP | 2006-201316 | 8/2006 |
| JP | 2006-290515 | 10/2006 |
| JP | 2006-322947 | 11/2006 |
| JP | 2007-86173 | 4/2007 |
| JP | 2008-207885 | 9/2008 |
| JP | 2009-249046 | 10/2009 |
| JP | 2010-030772 | 2/2010 |
| JP | 2010-54558 | 3/2010 |
| JP | 2011-180481 | 9/2011 |
| JP | 2011-254248 | 12/2011 |

OTHER PUBLICATIONS

Office action mailed Jul. 9, 2013 in JP 2012-203504, including English translation 5pp.

Office action mailed Jul. 16, 2013 in JP 2012-185219, including English translation, 5pp.

Office action mailed Jul. 9, 2013 in JP 2012-202627, including English translation, 5pp.

Office action mailed Jul. 16, 2013 in JP 2012-195225, including English translation, 6pp.

Office action mailed Jul. 16, 2013 in JP 2012-195325, including English translation, 6pp.

* cited by examiner

PAPER CONVEYING APPARATUS, ABNORMALITY DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-203504, filed on Sep. 14, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection apparatus of a copier which converts the sound which is generated on the conveyance path to an electrical signal and determines that a jam has occurred when the time when the signal is over a reference level exceeds a reference value has been disclosed (see Japanese Laid-open Patent Publication No. 57-169767).

SUMMARY

When the parts etc., of a paper conveying apparatus make a sound, sometimes it is erroneously determined that a jam has occurred.

Accordingly, it is an object of the present invention to provide a paper conveying apparatus and an abnormality detection method that can suppress erroneous detection of occurrence of a jam by a sound due to a sound which is generated from the apparatus and a computer-readable, non-transitory medium storing a computer program for causing a computer to implement such an abnormality detection method.

According to an aspect of the apparatus, there is provided a paper conveying apparatus. The paper conveying apparatus includes a sound signal generator, provided with a sound detector near a conveyance path of paper, for generating a sound signal, a sound jam detector for determining whether a jam has occurred based on the sound signal output during a paper conveying operation, a control module for performing abnormal processing when the sound jam detector determines that the jam has occurred, and an abnormal sound detector for determining whether an abnormal sound has been generated based on the sound signal output before a paper conveying operation.

According to an aspect of the method, there is provide a jam detection method. The jam detection method includes acquiring a sound signal, determining whether a jam has occurred based on the sound signal output during a paper conveying operation, performing abnormal processing when determining that the jam has occurred in the determining step, and determining, by a computer, whether an abnormal sound has been generated based on the sound signal output before a paper conveying operation.

According to an aspect of the computer-readable, non-transitory medium storing a computer program, the computer program causes a computer to execute a process, including acquiring a sound signal, determining whether a jam has occurred based on the sound signal output during a paper conveying operation, performing abnormal processing when determining that the jam has occurred in the determining step, and determining whether an abnormal sound has been generated based on the sound signal output before a paper conveying operation.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
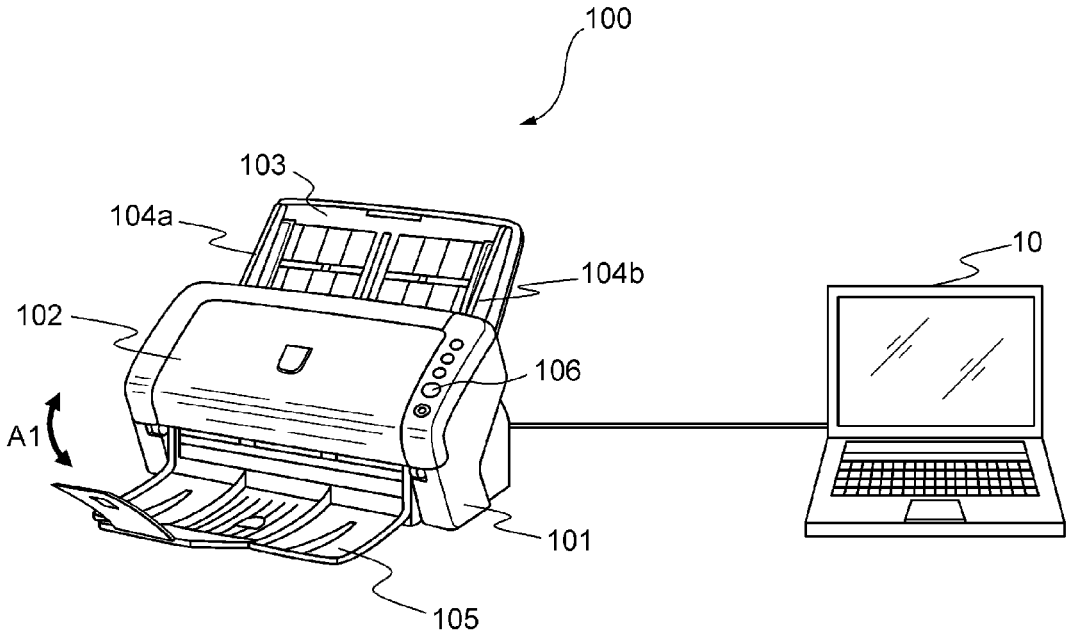
FIG. 1 is a perspective view which shows a paper conveying apparatus 100 and image processing apparatus 10 according to an embodiment.

FIG. 1 is a perspective view which shows a paper conveying apparatus 100 which are configured as an image scanner, and an information processing apparatus 10, according to an embodiment.

The paper conveying apparatus 100 includes a lower housing 101, an upper housing 102, a paper tray 103, an ejection tray 105, an operation button 106, etc., and is connected to an information processing apparatus (for example, personal computer, portable data terminal, etc.)

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
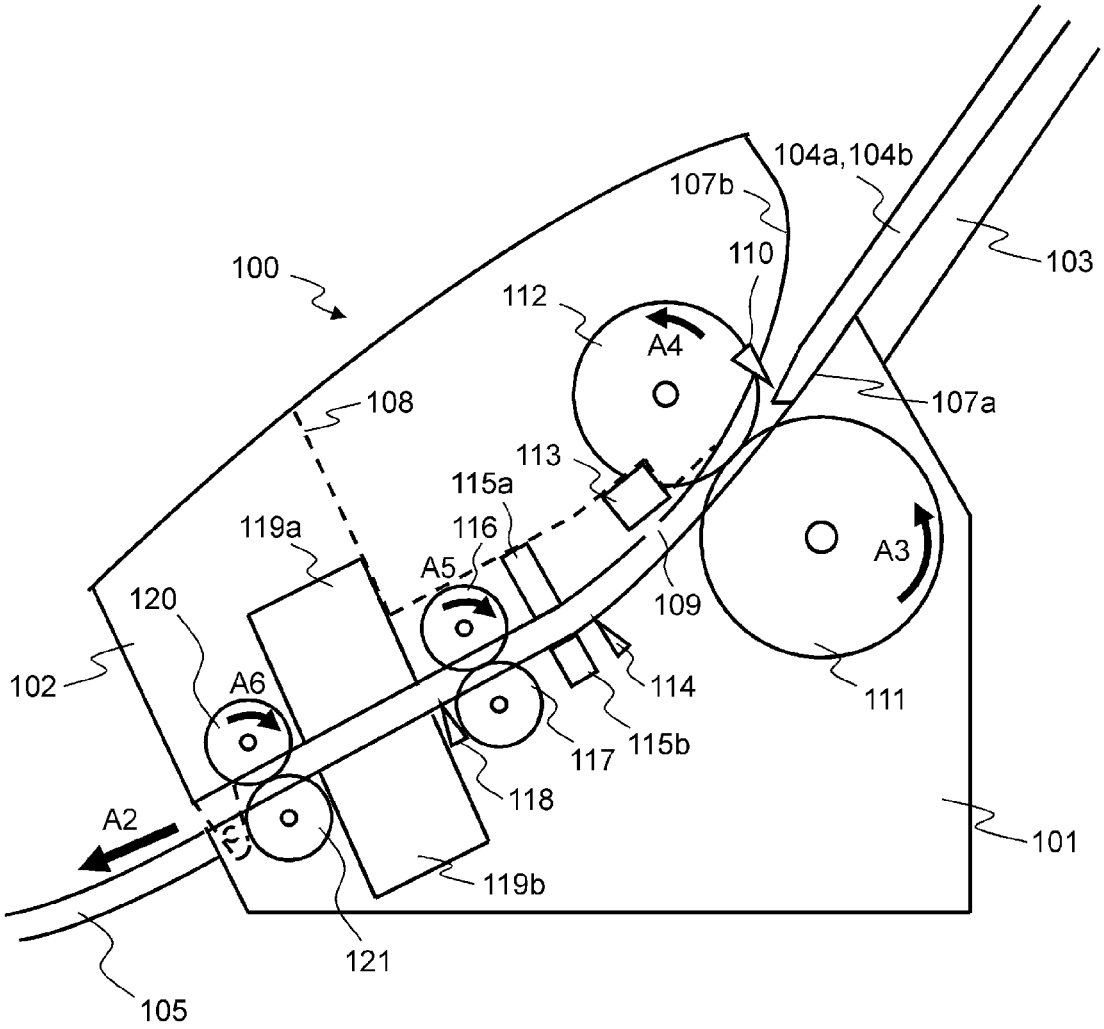
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, a paper feed roller 111, a retard roller 112, a microphone 113, a second paper detector 114, an ultrasonic transmitter 115*a*, an ultrasonic receiver 115*b*, a first conveyor roller 116, a first driven roller 117, a third paper detector 118, a first image capture unit 119*a*, a second image capture unit 119*b*, a second conveyor roller 120, a second driven roller 121, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 113 is an example of a sound detector, is provided near a conveyance path of a paper, and detects the sound generated by a paper during conveyance of the paper, and generates and outputs an analog signal corresponding to the detected sound. The microphone 113 is arranged at the downstream side of the paper feed roller 111 and the retard roller 112 while fastened to the frame 108 at the inside of the upper housing 102. A hole 109 is provided in the upper guide 107*b* facing the microphone 113, so that the sound generated by the paper during conveyance of the paper can be more accurately detected by the microphone 113.

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A5 of FIG. 2. The paper which is read by the image capture unit 119 is ejected onto the ejection tray 105 by the second conveyor roller 120 rotating in the direction of the arrow mark A6 of the FIG. 2.

Figure 3:
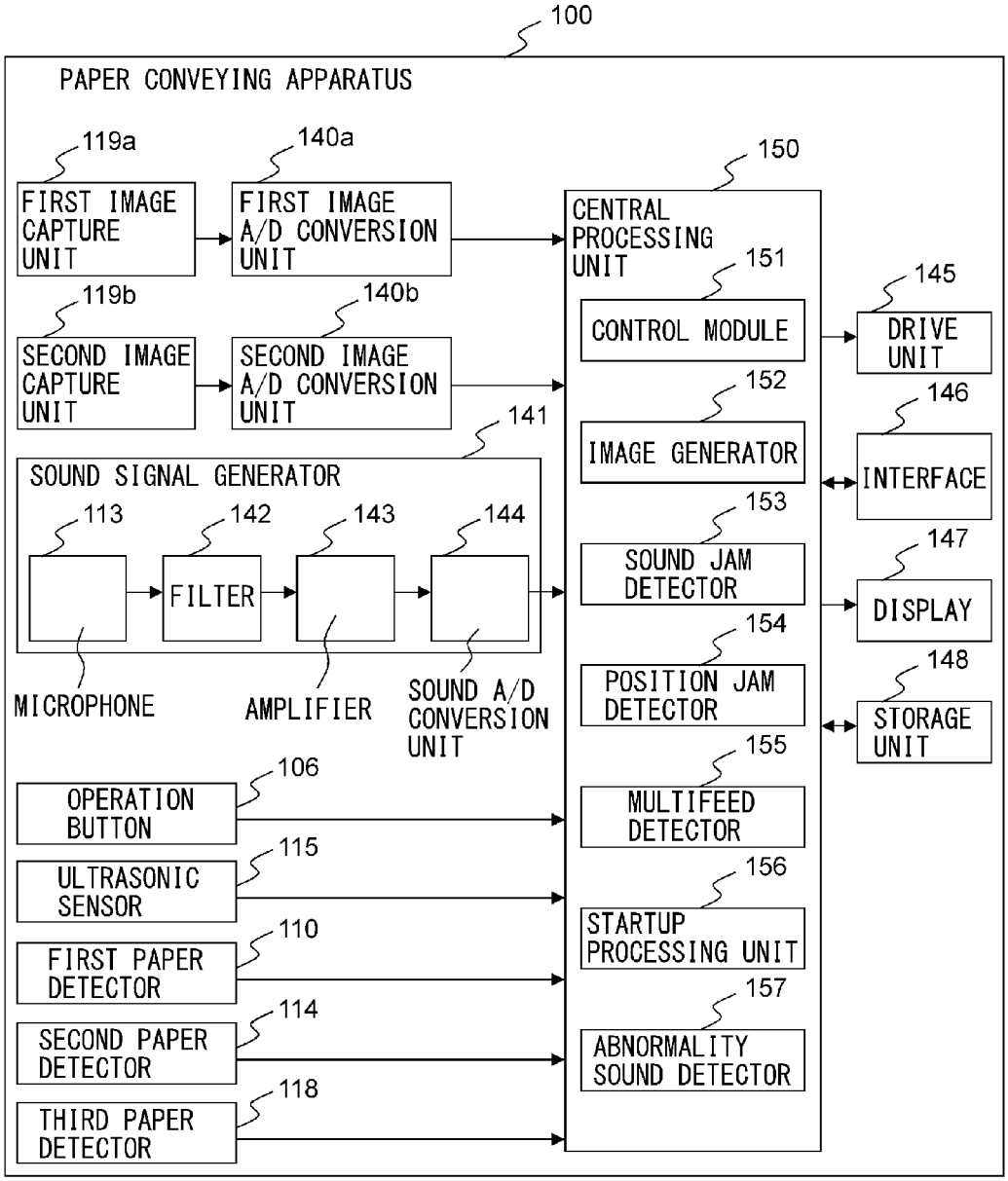
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

The sound signal generator 141 includes a microphone 113, a filter 142, an amplifier 143, a sound A/D conversion unit 144, etc., and generates a sound signal. The filter 142 applies a bandpass filter which passes a predetermined frequency band of a signal to an analog signal which is output from the microphone 113 and outputs it to the amplifier 143. The amplifier 143 amplifies the signal which is output from the filter 142 and outputs it to the sound A/D conversion unit 144. The sound A/D conversion unit 144 samples the analog signal which is output from the amplifier 143 at predetermined sampling rate to convert it to a digital format and generates a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 113, while the filter 142, the amplifier 143, and the sound A/D conversion unit 144 may be provided outside of the sound signal generator 141. Further, the sound signal generator 141 may include only the microphone 113 and the filter 142 or only the microphone 113, the filter 142, and the amplifier 143.

The drive unit 145 includes one or more motors and uses control signals from the central processing unit 150 to rotate the paper feed roller 111, the retard roller 112, the first conveyor roller 116, and the second conveyor roller 120 and operate to convey a paper. For example, the drive unit 145 separately includes a motor for rotating the paper feed roller and a motor for rotating the retard roller 112, the first conveying roller 116, and the second conveying roller 120.

The interface 146 has, for example, a USB or other serial bus-based interface circuit and electrically connects with the information processing apparatus 10 to send and receive a read image and various types of information. Further, it is also possible to connect a flash memory etc., to the interface 146 so as to store the read image.

The display 147 is an example of a warning display, and has a touch panel type display and an interface circuit which receives, as input, signals which correspond to operations of the user performed on the touch panel and which outputs images to the display. The display unit 147 outputs signals which correspond to operations of the user to the central processing unit 150 and displays images on the display according to the control from the central processing unit 150.

The storage unit 148 has a RAM (random access memory), ROM (read only memory), or other memory device, a hard disk or other fixed disk device, or flexible disk, optical disk, or other portable storage device. Further, the storage unit 148 stores a computer program, database, tables, etc., which are used in various processing of the paper conveying apparatus 100. The computer program may be installed on the storage unit 148 from a computer-readable, non-transitory medium such as a compact disk read only memory (CD-ROM), a digital versatile disk read only memory (DVD-ROM), or the like by using a well-known setup program or the like. Furthermore, the storage unit 148 stores the read images and scanning information input by a user. The scanning information includes information about a resolution for scanning a paper.

The central processing unit 150 is provided with a CPU (central processing unit) and operates based on a program which is stored in advance in the storage unit 148. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 114, ultrasonic sensor 115, third paper detector 118, first image capture unit 119*a*, second image capture unit 119*b*, first image A/D conversion unit 140*a*, second image A/D conversion unit 140*b*, sound signal generator 141, drive unit 145, interface 146, and storage unit 148 and controls these units.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, a startup processing unit 156, an abnormal sound detector 157, etc. These units are functional modules which are realized by software which operate on a processor. Note that, these units may be comprised of respectively independent integrated circuits, a microprocessor, firmware, etc.

Figure 4:
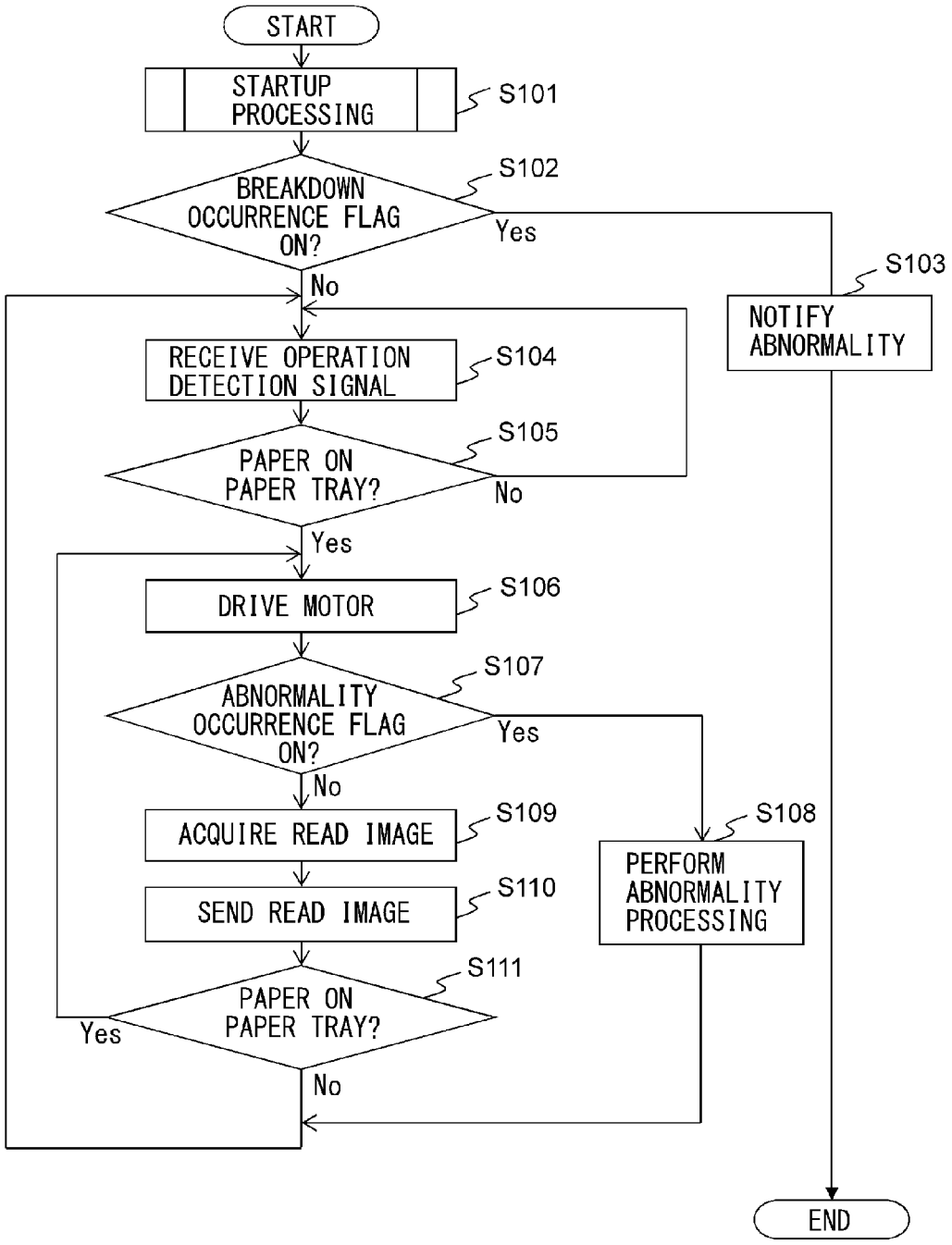
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 148 mainly by the central processing unit 150 in cooperation with the elements of the paper conveying apparatus 100.

First, the central processing unit 150 executes the startup processing of the paper conveying apparatus 100 if the paper conveying apparatus 100 has been started up (step S101). Details of the startup processing will be explained later.

Next, the central processing unit 150 determines whether a breakdown occurrence flag is ON (step S102). This breakdown occurrence flag, as explained later, is set to ON if it is determined at the startup processing of step S101 that a breakdown has occurred in the apparatus (see FIG. 5).

Next, when the breakdown occurrence flag is ON, the central processing unit 150 notifies the user of the occurrence of an abnormality by a not shown speaker, LED (light emitting diode), etc., (step S103) and ends the series of steps. In this case, the subsequent processing is not executed and the paper conveyance operation and reading operation are prohibited.

On the other hand, when the breakdown occurrence flag is OFF, the central processing unit 150 stands by until the operating button 106 is pressed by a user and an operation detection signal is received from the operating button 106 (step S104).

Next, the central processing unit 150 determines whether the paper tray 103 has a paper placed on it based on the first paper detection signal which was received from the first paper detector 110 (step S105).

If the paper tray 103 does not have a paper placed on it, the central processing unit 150 returns the processing to step S104 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 121 and convey the paper (step S106).

Next, the control module 151 determines whether an abnormality flag is ON or not (step S107). This abnormality occurrence flag, as explained later, is set to ON if it is determined in the abnormality detection processing that an abnormality has occurred (see FIG. 8).

When the abnormality flag is ON, the control module 151, as an abnormal processing, stops the drive unit 145 to stop the conveyance of the paper, uses a not shown speaker, LED, etc., to notify the user of the occurrence of an abnormality, sets the abnormality flag OFF (step S108). In this case, the control module 151 returns the processing to step S104 and stands by until newly receiving an operation detection signal from the operating button 106.

On the other hand, when the abnormality flag is not ON, the image generator 152 makes the first image capture unit 119*a* and the second image capture unit 119*b* read the conveyed paper and acquires the read image through the first image A/D conversion unit 140*a* and the second image A/D conversion unit 140*b* (step S109).

Next, the central processing unit 150 transmits the acquired read image through the interface 146 to a not shown information processing apparatus (step S110). Note that, when not connected to an information processing apparatus, the central processing unit 150 stores the acquired read image in the storage unit 147.

Next, the central processing unit 150 determine whether the paper tray 103 has a paper remaining thereon based on the first paper detection signal which was received from the first paper detector 110 (step S111).

When the paper tray 103 has a paper remaining thereon, the central processing unit 150 returns the processing to step S106 and repeats the processing of steps S106 to S111. On the other hand, when the paper tray 103 does not have any paper remaining thereon, the central processing unit 150 returns the processing to step S104 and stands by until newly receiving an operation detection signal from the operation button 106.

Figure 5:
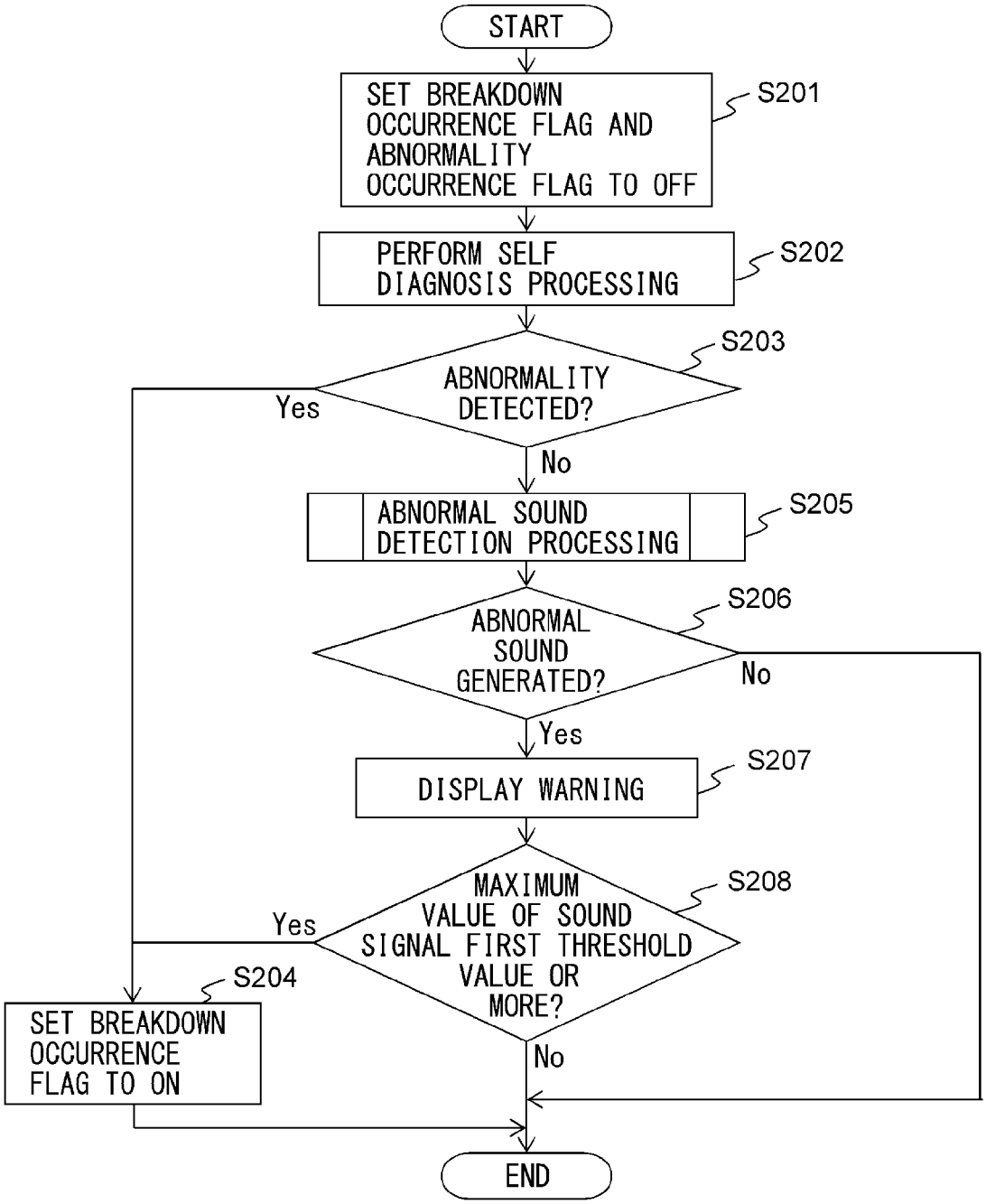
FIG. 5 is a flow chart which shows an example of operations in startup processing.

FIG. 5 is a flow chart which shows an example of the operations in the startup processing.

The flow of the operations which are shown in FIG. 5 is executed at step S101 of the flow chart which is shown in FIG. 4.

First, the startup processing unit 156 sets the breakdown occurrence flag and abnormality occurrence flag to OFF (step S201).

Next, the startup processing unit 156 executes the self diagnosis processing of the apparatus (step S202). The startup processing unit 156 confirms that the storage unit 148 can be normally read out from or written in, that the ultrasonic sensor 115, the image capture unit 119, the interface 146, the display 147, and other parts normally operate, the motors which the drive unit 145 has normally operate, etc.

Next, the startup processing unit 156 determines whether an abnormality has been detected in the self diagnosis processing (step S203).

When an abnormality is detected in the self diagnosis processing, the startup processing unit 156 sets the breakdown occurrence flag to ON (step S204) and ends the series of steps.

On the other hand, when no abnormality is detected in the self diagnosis processing, the abnormal sound detector 157 executes abnormal sound detection processing (step S205). The abnormal sound detector 157 determines whether an abnormal sound has been generated based on the sound signal before the paper conveying operation in the abnormal sound detection processing. An "abnormal sound" means a sound which occurs inside the apparatus when a paper is not being conveyed and which affects detection of a jam by sound. An "abnormal sound" includes sounds which are generated due to wear of parts, depletion of grease, etc., such as the creaking sound of a pulley, the vibration sound of a gear, etc. Details of the abnormal sound detection processing will be explained later.

Next, the abnormal sound detector 157 determines whether it has been determined an abnormal sound occurs in abnormal sound detection processing (step S206).

The abnormal sound detector 157 does not particularly perform any processing and ends the series of steps when it has been determined no abnormal sound has been generated. On the other hand, the abnormal sound detector 157 makes the display 147 display a warning that jam detection based on a sound signal has become unstable when it has been determined an abnormal sound has occurred (step S207). The point of jam detection based on a sound signal becoming unstable will be explained later.

Figure 6:
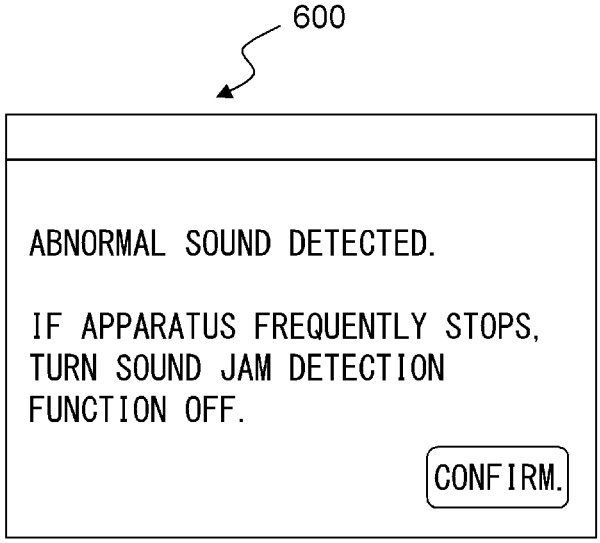
FIG. 6 is a view which shows an example of a warning display screen.

FIG. 6 is a view which shows an example of the warning display screen 600.

The warning display screen 600 which is shown in FIG. 6 shows an example of a screen which displays a warning that jam detection based on a sound signal has become unstable.

Note that, instead of making the display unit 147 display a warning, the abnormal sound detector 157 may also send a warning to the data processing apparatus 10 through the interface 146 that jam detection based on a sound signal has become unstable. In this case, data processing apparatus 10 displays the warning display screen 600 which is shown in FIG. 6. That is, the interface 146 is an example of a warning notifying module for warning to the outside of the paper conveying apparatus.

Next, the abnormal sound detector 157 determines whether the maximum value of the sound signal is a first threshold value Th1 or more (step S208).

The abnormal sound detector 157 does not particularly perform any processing and ends the series of steps when it determines the maximum value of the sound signal is less than the first threshold value Th1. On the other hand, the abnormal sound detector 157 sets the breakdown occurrence flag to ON when the maximum value of the sound signal is the first threshold value Th1 or more (step S204) and then ends the series of steps. The first threshold value Th1 is set to a value which corresponds to a sound volume which is envisioned when the apparatus has broken down or a sound volume which is envisioned as being unpleasant to the user. By setting the breakdown occurrence flag to ON, subsequent paper conveying operations are prohibited.

The paper conveying apparatus 100 can perform the basic function of driving the drive unit 145 to convey a paper and making the image capture unit 119 read the paper even if an abnormal sound has occurred. However, if an abnormal sound has occurred, there is a high possibility that correct detection by sound whether a jam has occurred will not be possible. The paper conveying apparatus 100 notifies the user that an abnormal sound has occurred and enables the user to determine whether to determine the occurrence of a jam by sound.

On the other hand, the paper conveying apparatus 100 prohibits the conveyance operation of a paper so that the situation does not worsen when a sound of a level which is envisioned as meaning the apparatus has broken down or a sound of a level which is felt unpleasant by the user occurs.

Figure 7:
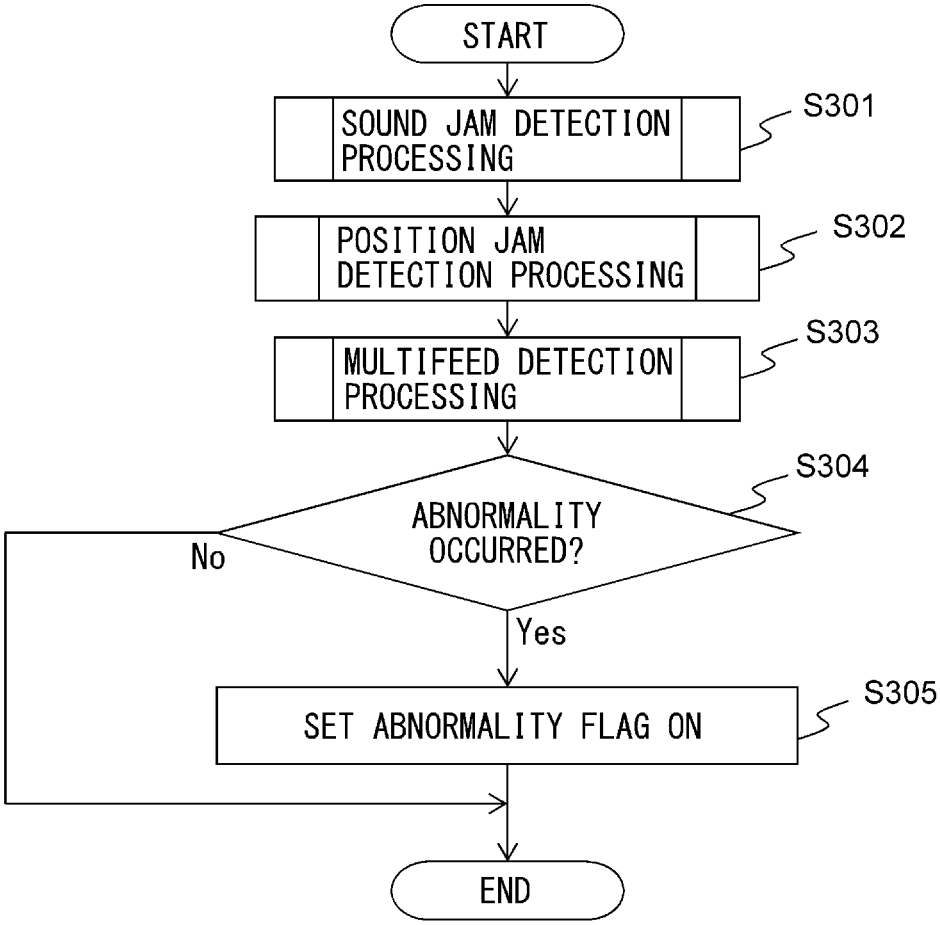
FIG. 7 is a flow chart which shows an example of an abnormality detection of the paper conveyance.

FIG. 7 is a flow chart which shows an example of an abnormality detection of the paper conveyance of the paper conveying apparatus 100.

The flow of operation which is explained below is executed based on a program which is stored in advance in the storage unit 148 mainly by the central processing unit 150 in cooperation with the elements of the paper conveying apparatus 100.

First, the sound jam detector 153 executes sound jam detection processing (step S301). In the sound jam detection processing, the sound jam detector 153 determines whether a jam has occurred based on the sound signal in the paper conveying operation. Below, sometimes a jam which is determined to exist by the sound jam detector 153 based on a sound signal will be called a "sound jam". Details of the sound jam detection processing will be explained later.

Next, the position jam detector 154 performs position jam detection processing (step S302). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S303). In the multifeed detection processing, the multifeed detector 155 determines the occurrence of a multifeed of papers based on the ultrasonic signal which was acquired from the ultrasonic sensor 116. Details of the multifeed detection processing will be explained later.

Next, the control module 151 determines whether an abnormality has occurred in the paper conveyance processing (step S304). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 7 is repeatedly executed every predetermined time interval.

Figure 8:
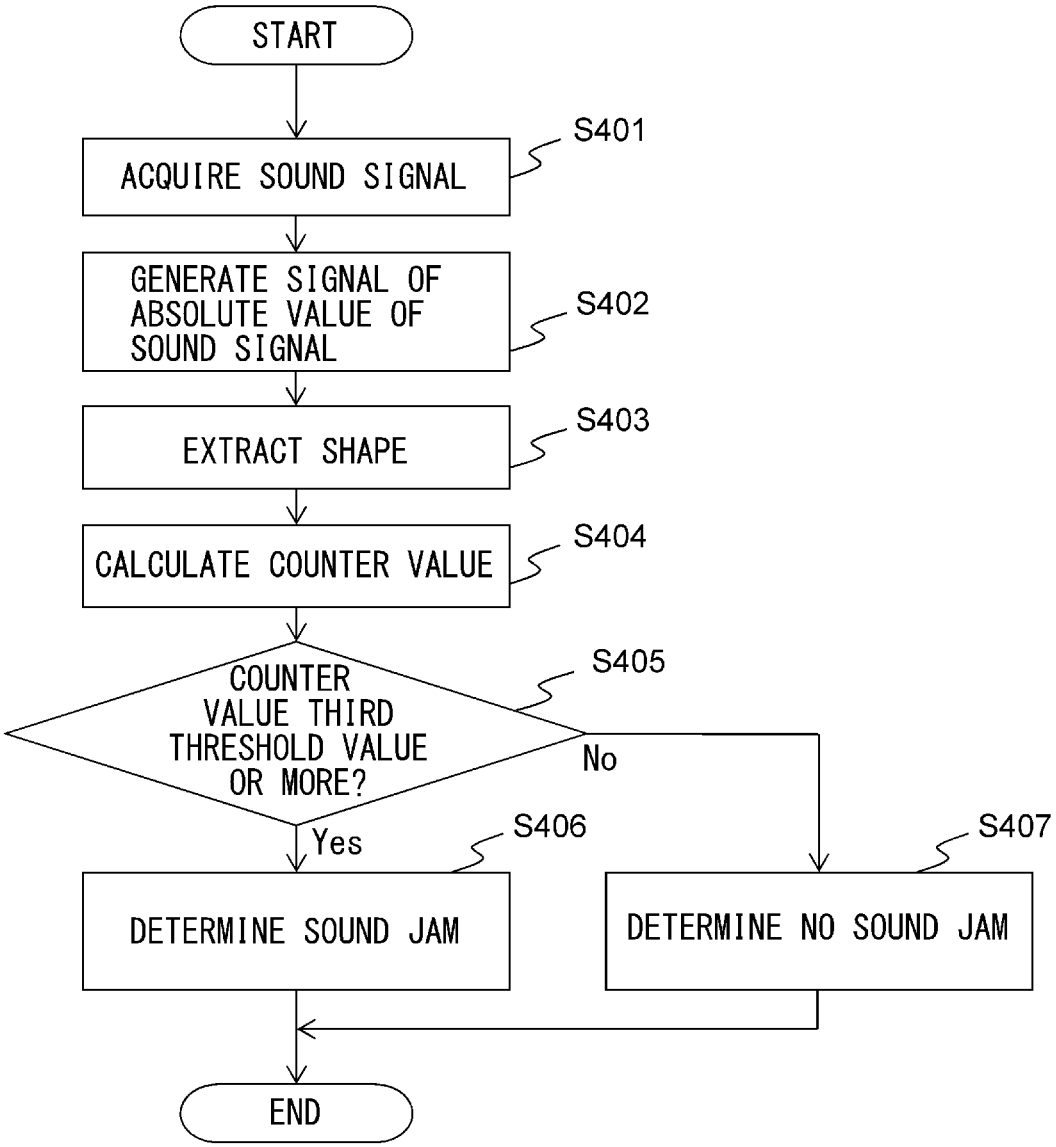
FIG. 8 is a flow chart which shows an example of operation of sound jam detection processing.

FIG. 8 is a flow chart which shows an example of operation of a sound jam judgment processing.

The flow of operation which is shown in FIG. 8 is executed at step S301 of the flow chart which is shown in FIG. 7.

First, the sound jam detector 153 acquires a sound signal from the sound signal generator 141 (step S401).

Next, the sound jam detector 153 generates an absolute value signal which acquires the absolute value of the sound signal (step S402).

Next, the sound jam detector 153 generates a shape signal which extracts the shape of the absolute value signal (step S403). The sound jam detector 153 generates as the shape signal a signal which acquires the peak hold value of the absolute value signal. The sound jam detector 153 holds the local maximum value of the absolute value signal for exactly a certain hold time period, then causes it to attenuate by a certain attenuation rate so as to generate a shape signal.

Next, the sound jam detector 153 calculates a counter value which it increases when the signal value of the shape signal is a second threshold value Th2 or more and which it decreases when it is less than the second threshold value Th2 (step S404). The sound jam detector 153 determines whether the signal value of the shape signal is the second threshold value Th2 or more every predetermined time interval (for example, sampling interval of sound signal), increments the counter value when the signal value of the shape signal is the second threshold value Th2 or more, and decrements the counter value when it is less than the second threshold value Th2.

Next, the sound jam detector 153 determines whether the counter value is a third threshold value Th3 or more (step S405). The sound jam detector 153 determines that a sound jam has occurred if the counter value is the third threshold value Th3 or more (step S406) and determines that no sound jam has occurred if the counter value is less than the third threshold value Th3 (step S407), then the series of steps is ended. Note that, for the third threshold value Th3, the minimum value of the counter values which are calculated when a jam occurs when performing an experiment to cause a jam several times is set.

Figure 9A:
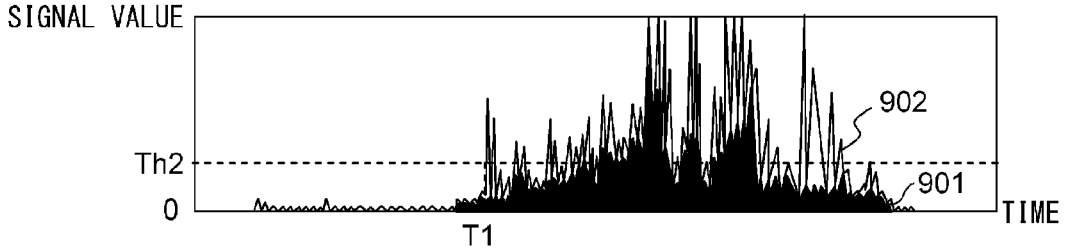
FIG. 9A is a graph which shows an example of an absolute value signal and shape signal at the time of occurrence of a jam.
Figure 9B:
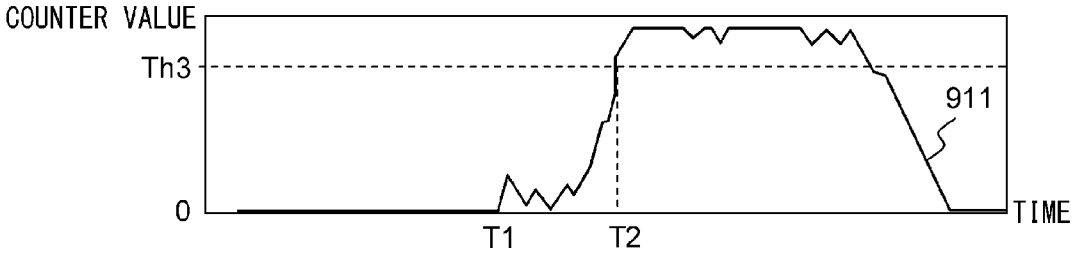
FIG. 9B is a graph which shows an example of a counter value at the time of occurrence of a jam.

FIGS. 9A and 9B are graphs which show an example of the signals relating to sound jam detection when a jam has occurred.

In FIG. 9A and FIG. 9B, the abscissas show time, in FIG. 9A, the ordinate shows the signal value, and in FIG. 9B, the ordinate shows the counter value. The graph of FIG. 9A shows an example of the absolute value signal 901 when a jam has occurred and the shape signal 902 which is generated from the absolute value signal 901 (see FIG. 8, steps S402 and S403). The graph of FIG. 9B shows an example of the counter value 911 which is calculated for the shape signal 902 (see FIG. 8, step S404).

In FIG. 9A, the shape signal 902 becomes the second threshold value Th2 or more at the time T1, then frequently becomes the second threshold value Th2 or more. As shown in FIG. 9B, the counter value 911 increases from the time T1, then repeatedly changes and becomes the third threshold value Th3 or more at the time T2, so it is determined that a sound jam has occurred.

Figure 10A:
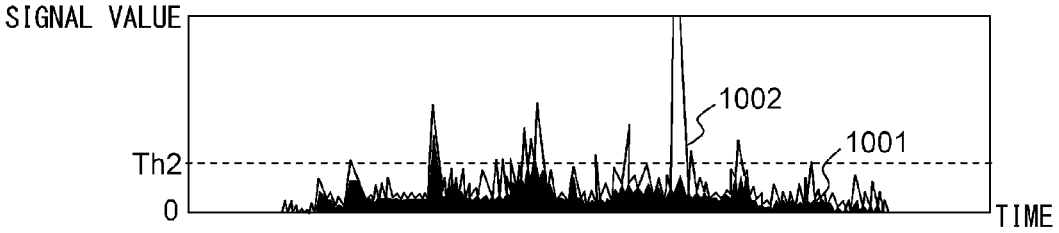
FIG. 10A is a graph which shows an example of an absolute value signal and a shape signal when conveying wrinkled paper.
Figure 10B:
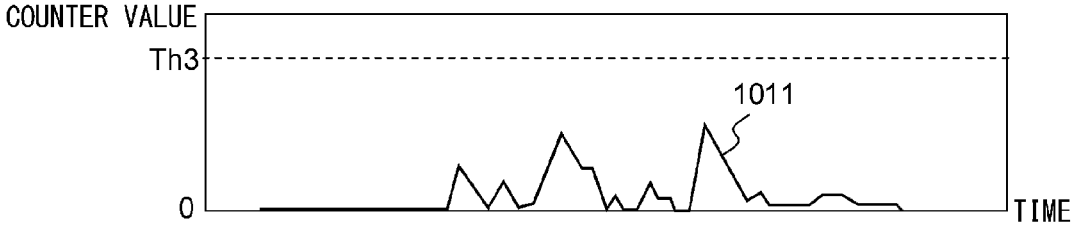
FIG. 10B is a graph which shows an example of a counter value at the time of conveying wrinkled paper.

FIGS. 10A and 10B are graphs which show examples of signals relating to sound jam detection when a paper which has wrinkles (hereinafter referred to as "wrinkled paper") is conveyed.

In FIG. 10A and FIG. 10B, the abscissas show time, in FIG. 10A, the ordinate shows the signal value, and in FIG. 10B, the ordinate shows the counter value. The graph of FIG. 10A shows examples of the absolute value signal 1001 when wrinkled paper has been conveyed and the shape signal 1002 which is generated from the absolute value signal 1001 (see FIG. 8, steps S402 and S403). The graph of FIG. 10B shows an example of the counter value 1011 which is calculated for the shape signal 1002 (see FIG. 8, step S404).

When wrinkled paper is conveyed, as shown in FIG. 10A, the absolute value signal 1001 and shape signal 1002 sometimes become values of the second threshold value Th2 or more. However, as shown in FIG. 10B, the counter value 1011 increases to a certain magnitude, but does not become the third threshold value Th3 or more, so it is determined that no sound jam has occurred.

Figure 11:
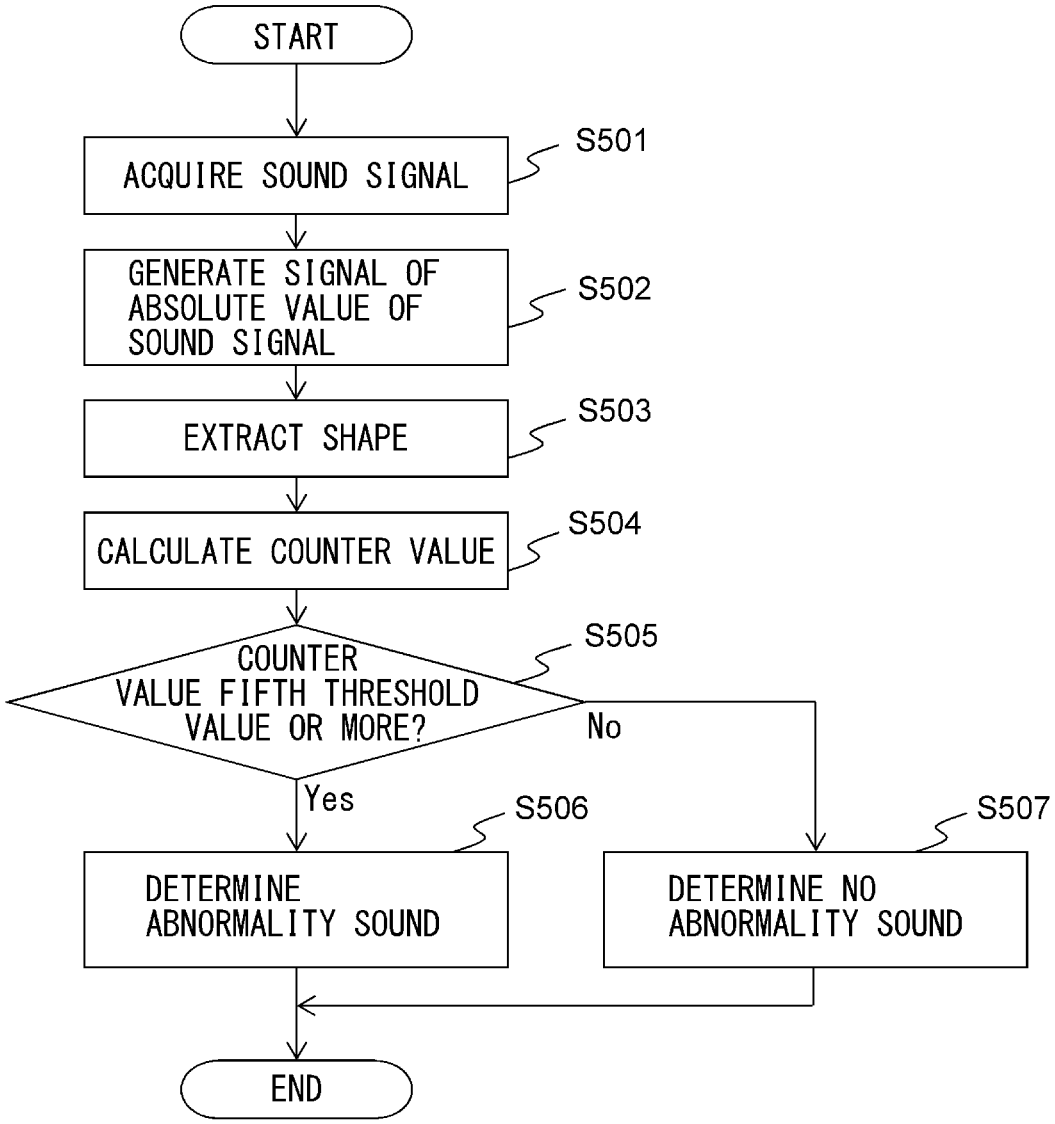
FIG. 11 is a flow chart which shows an example of operations in abnormal sound detection processing.

FIG. 11 is a flow chart which shows an example of operations in abnormal sound detection processing.

The flow of operation which is shown in FIG. 11 is executed at step S205 of the flow chart which is shown in FIG. 5.

First, the abnormal sound detector 157 acquires a sound signal from the sound signal generator 141 (step S501).

Next, the abnormal sound detector 157 generates an absolute value signal which acquires the absolute value of the sound signal (step S502).

Next, the abnormal sound detector 157 generates a shape signal which extracts the shape of the absolute value signal (step S503). The abnormal sound detector 157 generates as the shape signal a signal which acquires the peak hold value of the absolute value signal. The abnormal sound detector 157 holds the local maximum value of the absolute value signal for exactly a certain hold time period, then causes it to attenuate by a certain attenuation rate so as to generate a shape signal.

Next, the abnormal sound detector 157 calculates a counter value which it increases when the signal value of the shape signal is a forth threshold value Th4 or more and which it decreases when it is less than the forth threshold value Th4 (step S504). The abnormal sound detector 157 determines whether the signal value of the shape signal is the fourth threshold value Th4 or more every predetermined time interval (for example, sampling interval of sound signal), increments the counter value when the signal value of the shape signal is the fourth threshold value Th4 or more, and decrements the counter value when it is less than the fourth threshold value Th4. The fourth threshold value Th4 is set to a value the same as the second threshold value Th2 and smaller than the first threshold value Th1.

Next, the abnormal sound detector 157 determines whether the counter value is a fifth threshold value Th5 or more (step S505). The abnormal sound detector 157 determines that an abnormal sound has occurred if the counter value is the fifth threshold value Th5 or more (step S506) and determines that no abnormal sound has occurred if the counter value is less than the fifth threshold value Th5 (step S507), then the series of steps is ended. The fifth threshold value Th5 is set to a value of ½ of the third threshold value Th3. Note that, the setting of the fifth threshold value Th5 will be explained later.

Note that, the abnormal sound detection processing which is shown in FIG. 11 may be performed not right after starting up the power, but from driving the drive unit 145 to rotate the paper feed roller 111, the retard roller 112, the first conveying roller 116, and the second conveying roller 120 to when the paper is actually conveyed.

Figure 12A:
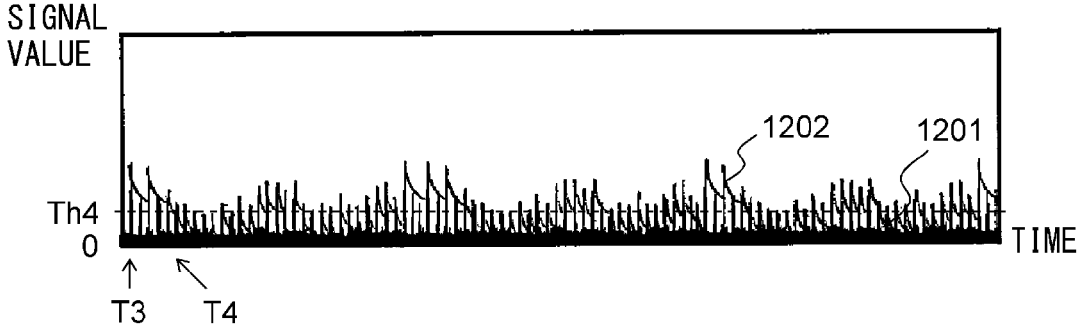
FIG. 12A is a graph which shows an example of an absolute value signal and a shape signal at the time of occurrence of an abnormal sound.
Figure 12B:
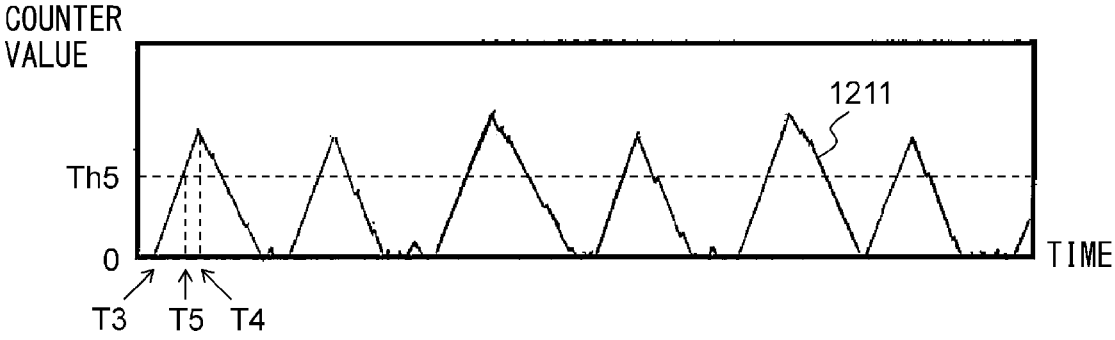
FIG. 12B is a graph which shows an example of a counter value at the time of occurrence of an abnormal sound.

FIG. 12A to 12B are graphs which show examples of signals relating to abnormal sound detection in the case where an abnormal sound has occurred.

In FIG. 12A and FIG. 12B, the abscissas show time, in FIG. 12A, the ordinate shows the signal value, and in FIG. 12B, the ordinate shows the counter value. The graph of FIG. 12A shows an example of the absolute value signal 1201 in the case where an abnormal sound has occurred and a shape signal 1202 which is generated from the absolute value signal 1201 (see FIG. 11, steps S502 and S503). The graph of FIG. 12B shows an example of the counter value which is calculated for the shape signal 1202 (see FIG. 11, step S504).

In FIG. 12A, the shape signal 1202 becomes the second threshold value Th2 or more at the time T3, then does not become less than the fourth threshold value Th4 until the time T4. As shown in FIG. 12B, the counter value 1211 increases from the time T3 and becomes the fifth threshold value Th5 or more at the time T5. The abnormal sound detector 157 then determines that an abnormal sound has occurred.

Below, what kind of state "the sound jam detection becomes unstable when an abnormal sound is generated" is will be explained (see FIG. 5, step S207).

If a paper is conveyed when a creaking sound of a pulley, a vibration sound of a gear, etc., occurs, the microphone 113 will detect the conveyance sound of the paper in addition to the creaking sound of the pulley, vibration sound of the gear, etc. The sound signal generator 141 will then output a sound signal comprised of two types of sounds superposed. The sound jam detector 153 will calculate the counter value based on the sound signal comprised of two types of sounds superposed. If the counter value becomes the third threshold value Th3 or more, it will be determined that a sound jam has occurred. That is, the increase in the counter value due to conveyance of wrinkled paper is added to the increase in the counter value due to the creaking sound of a pulley, the vibration sound of a gear, etc. If over the third threshold value Th3, it is determined that a jam has occurred despite no jam having occurred.

As explained above, for the third threshold value Th3, the minimum value of the counter values which the sound jam detector 153 calculates when a jam occurs when performing an experiment to cause a jam several times is set. Further, various types of wrinkled paper were conveyed and the counter values which the sound jam detector 153 calculated were investigated, whereupon they were in the range of 25% to 75% of the third threshold value Th3.

As explained above, in a situation where it is not certain what kind of wrinkled paper is being conveyed, if the creaking sound of a pulley, the vibration sound of a gear, etc., alone cause the counter value which the sound jam detector 153 calculates to become 25% or more of the third threshold value Th3, there is a possibility that it will be determined that a jam has occurred despite no jam having occurred. On the other hand, when the creaking sound of a pulley, the vibration sound of a gear, etc., alone cause the counter value which the sound jam detector 153 calculates to become the third threshold value Th3 or more, that alone causes it to be determined a jam has occurred, so this is not desirable.

Therefore, it was decided to determine that an abnormal sound has occurred if the creaking sound of a pulley, the vibration sound of a gear, etc. alone cause the counter value which the sound jam detector 153 calculates to become 25% or more of the third threshold value Th3. That is, in such a case, depending on the type of the wrinkled paper, there is a possibility that it is determined a jam occurs, so it was decided to determine that an abnormal sound by which the sound jam detection would become unstable has occurred. In this case, the fifth threshold value Th5 becomes ¼ of the third threshold value Th3.

However, if setting the reference value low, a warning will be issued too frequently, which is not desirable. Therefore, it is also possible to determine that an abnormal sound has occurred when the creaking sound of a pulley, the vibration sound of a gear, etc., alone cause the counter value which the sound jam detector 153 calculates to become 50% or more of the third threshold value Th3. That is, in such a case, depending on the type of the wrinkled paper, there is a possibility that it is determined a jam occurs, so it was decided to determine that an abnormal sound by which the sound jam detection would become unstable has occurred. In this case, the fifth threshold value Th5 becomes ½ of the third threshold value Th3. Note that, the fifth threshold value Th5 of step S505 is determined based on the above.

Note that, the third threshold value Th3 and the fifth threshold value Th5 and other values are not limited to the above-mentioned values and can be suitably changed.

Figure 13:
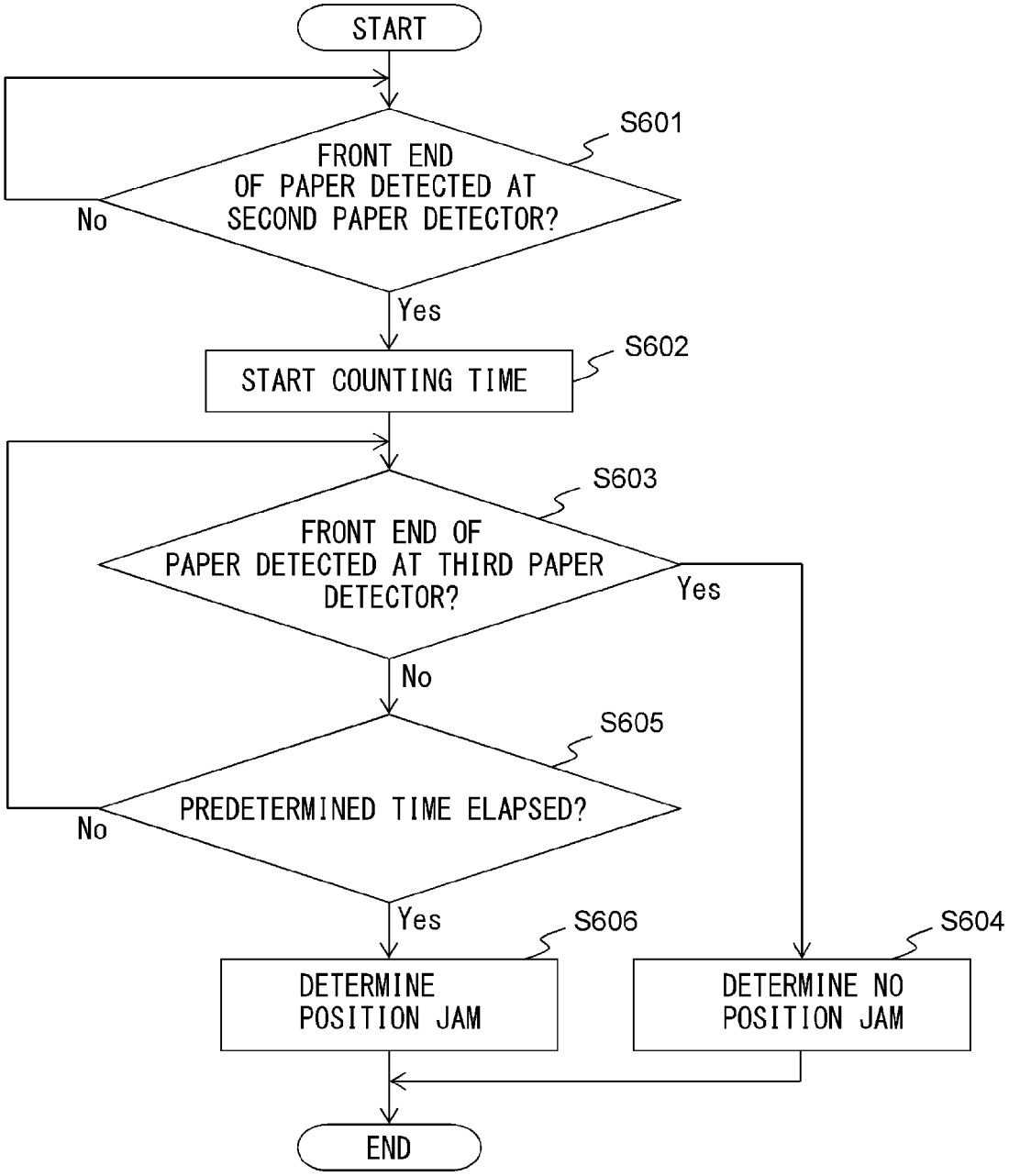
FIG. 13 is a flow chart which shows an example of operation of position jam detection processing.

FIG. 13 is a flow chart which shows an example of operation of a position jam detection processing.

The flow of operation which is shown in FIG. 13 is executed at step S302 of the flow chart which is shown in FIG. 7.

First, the position jam detector 154 stands by until the front end of the paper is detected by the second paper detector 114 (step S601). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S602).

Next, the position jam detector 154 determines whether the third paper detector 118 has detected the front end of the paper (step S603). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S604) and ends the series of steps.

On the other hand, if the third paper detector 118 detects the front end of the paper, the position jam detector 154 determines whether a predetermined time (for example, 1 second) has elapsed from the start of counting time (step S605). If a predetermined time has not elapsed, the position jam detector 154 returns to the processing of step S603 and again determines whether the third paper detector 118 has detected the front end of the paper. On the other hand, when a predetermined time has elapsed, the position jam detector 154 determines that position jam has occurred (step S606) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 118 does not detect the front end of a paper within a predetermined time.

Figure 14:
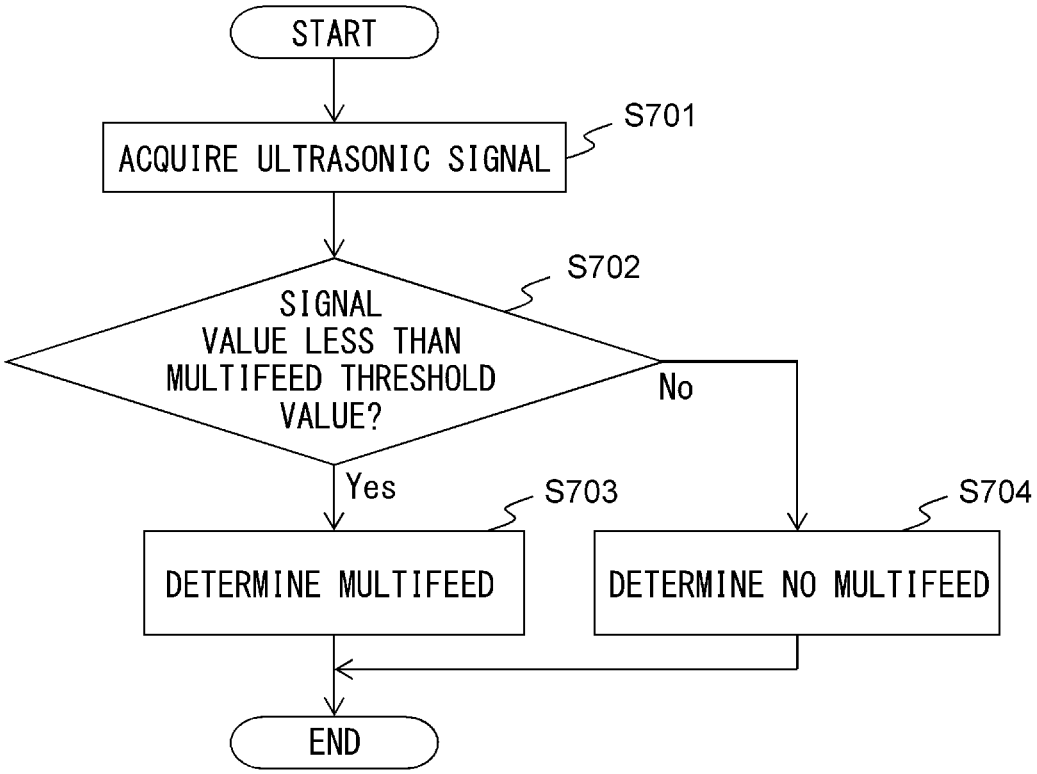
FIG. 14 is a flow chart which shows an example of operation of multifeed detection processing.

FIG. 14 is a flow chart which shows an example of operation of multifeed detection processing.

The flow of operation which is shown in FIG. 14 is executed at step S303 of the flow chart which is shown in FIG. 7.

First, the multifeed detector 155 acquires an ultrasonic signal from the ultrasonic sensor 115 (step S701).

Next, the multifeed detector 155 determines whether the signal value of the acquired ultrasonic signal is less than the multifeed detection threshold value (step S702).

Figure 15:
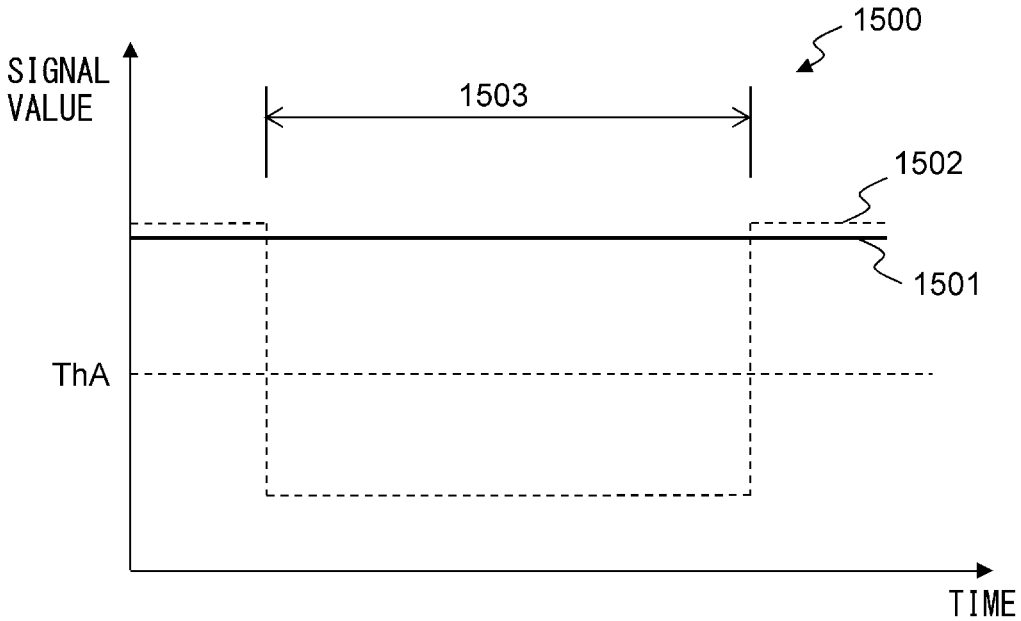
FIG. 15 a view for explaining properties of an ultrasonic signal.

FIG. 15 is a view for explaining properties of an ultrasonic signal.

In the graph 1500 of FIG. 15, the solid line 1501 shows the characteristic of the ultrasonic signal in the case where a single paper is conveyed, while the broken line 1502 shows the characteristic of the ultrasonic signal in the case where multifeed of papers has occurred. The abscissa of the graph 1500 shows the time, while the ordinate shows the signal value of the ultrasonic signal. Due to the occurrence of multifeed, the signal value of the ultrasonic signal of the broken line 1502 falls in the section 1503. For this reason, it is possible to determine whether multifeed of papers has occurred by whether the signal value of the ultrasonic signal is less than the multifeed detection threshold value ThA.

The multifeed detector 155 determines that multifeed of the papers has occurred when the signal value of the ultrasonic signal is less than the multifeed detection threshold value (step S703), determines that multifeed of the papers has not occurred when the signal value of the ultrasonic signal is the multifeed detection threshold value or more (step S704), and ends the series of steps.

As explained in detail above, the paper conveying apparatus 100 operates in accordance with the flow charts which are shown in FIG. 4, FIG. 5, and FIG. 11 to determine if an abnormal sound has occurred based on a sound signal which is output before a paper conveying operation. The paper conveying apparatus 100 displays a warning when an abnormal sound has been generated, so a user can invalidate the detection of occurrence of a jam by sound at the time of a paper conveying operation and so the paper conveying apparatus 100 can suppress erroneous detection of occurrence of a jam by sound.

Further, the paper conveying apparatus 100 makes the abnormal sound detection processing the same processing as the sound jam detection processing. Therefore, the fourth threshold value Th4 and the fifth threshold value Th5 which are used for the abnormal sound detection processing can be easily adjusted in accordance with the second threshold value Th2 and third threshold value Th3 which are used for the sound jam detection processing.

Figure 16:
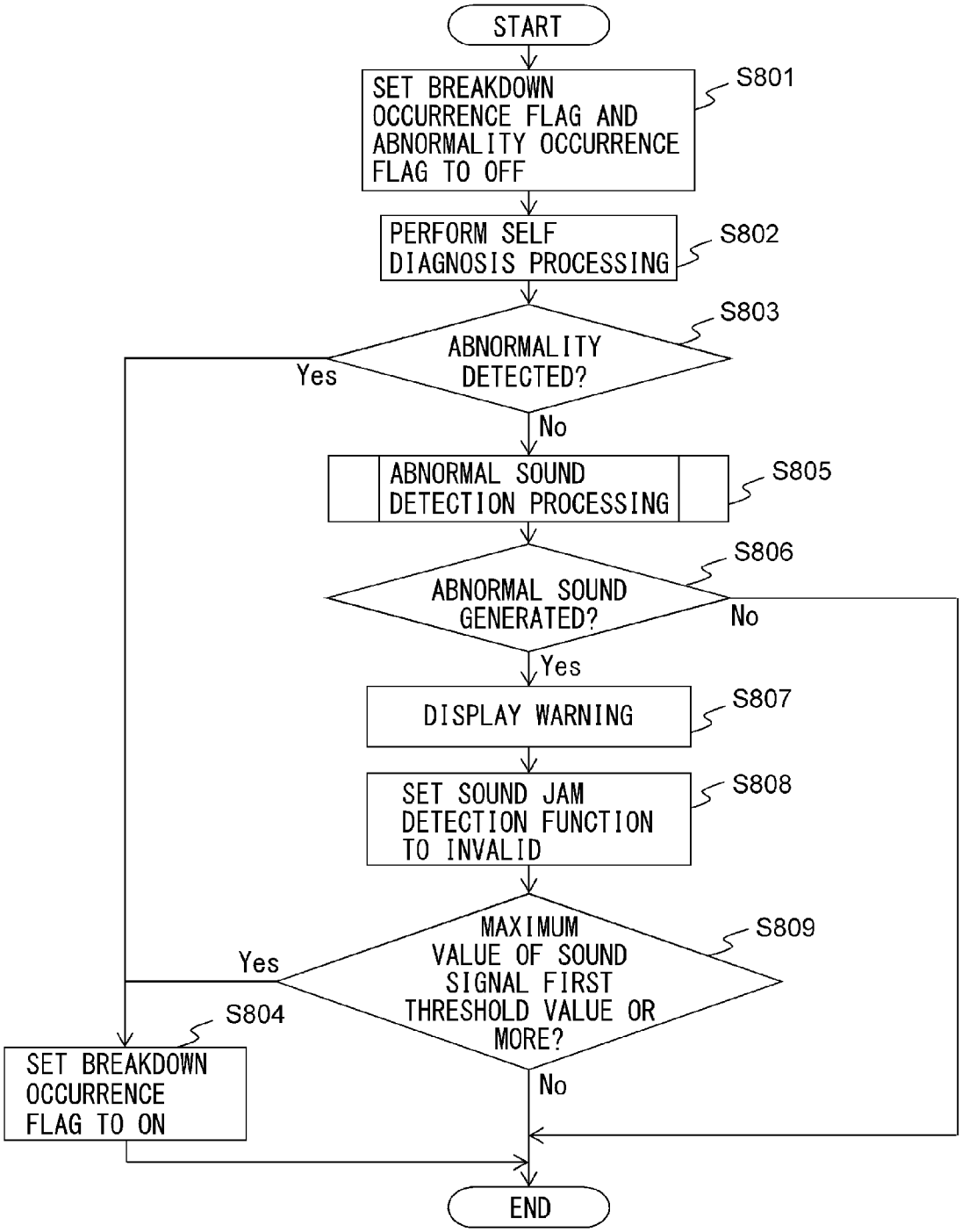
FIG. 16 is a flow chart which shows another example of operations in startup processing.

FIG. 16 is a flow chart which shows another example of the operations in startup processing.

In the paper conveying apparatus 100, this flow chart can be used instead of the above-mentioned flow chart which is shown in FIG. 5. In the flow chart which is shown in FIG. 16, unlike the flow chart which is shown in FIG. 5, the abnormal sound detector 157 sets the sound jam detection function to invalid when it determines that an abnormal sound has occurred. The processing of steps S801 to S806 and S809 which are shown in FIG. 16 is the same as the processing of steps S201 to S206 and S208 which are shown in FIG. 5, so the explanation will be omitted and only the processing of steps S807 to S808 will be explained.

When it is determined at step S806 that an abnormal sound has been generated, the abnormal sound detector 157 displays a warning to set the sound jam detection function to invalid on the display unit 147 (step S807).

Figure 17:
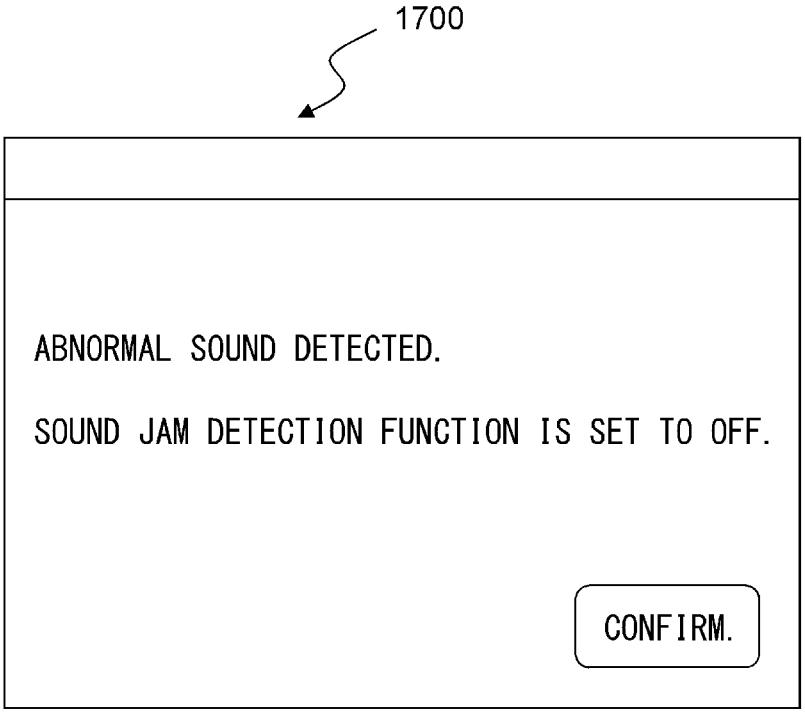
FIG. 17 is a view which shows another example of a warning display screen.

FIG. 17 is a view which shows an example of a warning display screen 1700.

The warning display screen 1700 which is shown in FIG. 17 shows an example of a screen which displays a warning which shows that the sound jam detection function is set to invalid.

Next, the abnormal sound detector 157 sets the sound jam detection flag to OFF (step S808). The sound jam detection flag is set to ON when starting up the apparatus and is set to OFF when the abnormal sound detector 157 determines that an abnormal sound has occurred.

On the other hand, in FIG. 7, at step S304, the control module 151 determines whether the sound jam detection flag has been set to ON. When the sound jam detection flag has been set to ON, the control module 151 determines that no abnormality has occurred even if the sound jam detector 153 determines that a sound jam has occurred.

As explained above in detail, the paper conveying apparatus 100 operates in accordance with the flow charts which are shown in FIG. 4, FIG. 5, FIG. 7, and FIG. 16 so when an abnormal sound is generated, can automatically invalidate the detection of occurrence of a jam by sound. Therefore, the paper conveying apparatus 100 can suppress mistaken detection of the occurrence of a jam by sound.

According to the paper conveying apparatus and the abnormality detection method, since it is determined whether an abnormal sound has occurred based on a sound signal which is output before a paper conveying operation, it becomes possible to invalidate the detection of the occurrence of a jam by sound at the time of a paper conveying operation when an abnormal sound has occurred. Therefore, it becomes possible to suppress erroneous detection of occurrence of a jam by sound.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a sound signal generator, provided with a sound detector near a conveyance path of paper, for generating a sound signal;

an abnormal sound detector for determining whether an abnormal sound has been generated based on the sound signal output before a paper conveying operation in the paper conveying apparatus;

a sound jam detector for determining whether a jam has occurred in the conveyance path based on the sound signal output during the paper conveying operation; and a control module for performing abnormal processing when the sound jam detector determines that the jam has occurred;

wherein the control module determines that the jam detection based on the sound signal becomes unstable when the abnormal sound detector determined that the abnormal sound has been generated.

2. The paper conveying apparatus according to claim 1, further comprising a warning display for warning that jam detection based on the sound signal will become unstable when the abnormal sound detector determines that an abnormal sound has been generated.

3. The paper conveying apparatus according to claim 1, further comprising a warning notifying module for warning to the outside of the paper conveying apparatus that jam detection based on the sound signal will become unstable when the abnormal sound detector determines that an abnormal sound has been generated.

4. The paper conveying apparatus according to claim 1, wherein the abnormal sound detector controls so that the control module does not perform the abnormal processing when the sound jam detector determined that a jam has occurred and the abnormal sound detector determined that an abnormal sound has been generated.

5. The paper conveying apparatus according to claim 1, wherein the abnormal sound detector prohibits the paper conveying operation when the abnormal sound detector determines that an abnormal sound having a predetermined threshold value or more has been generated.

6. An abnormality detection method comprising:

acquiring a sound signal from a sound signal generator, provided with a sound detector near a conveyance path of paper, for generating the sound signal;

determining, by a computer, whether an abnormal sound has been generated based on the sound signal output before a paper conveying operation in a paper conveying apparatus;

determining, by a computer, whether a jam has occurred in the conveyance path based on the sound signal output during the paper conveying operation; and performing abnormal processing when determining that the jam has occurred; and determining, by a computer, that the jam detection based on the sound signal is unstable, wherein the computer determines that the jam detection based on the sound signal becomes unstable when determining that the abnormal sound has been generated.

7. A computer-readable, non-transitory medium storing a computer program, wherein the computer program causes a computer to perform a process, the process comprising:

acquiring a sound signal from a sound signal generator, provided with a sound detector near a conveyance path of paper, for generating the sound signal;

determining, by the computer, whether an abnormal sound has been generated based on the sound signal output before a paper conveying operation in a paper conveying apparatus;

determining, by the computer, whether a jam has occurred in the conveyance path based on the sound signal output during the paper conveying operation; and performing abnormal processing when determining that the jam has occurred; and determining, by the computer, that the jam detection based on the sound signal is unstable, wherein the computer determines that the jam detection based on the sound signal becomes unstable when determining that the abnormal sound has been generated.

* * * * *